United States Patent [19]

Shemitz

[11] 4,173,034

[45] Oct. 30, 1979

[54] LIGHTING SYSTEM WITH BAFFLE

[76] Inventor: Sylvan R. Shemitz, Sunbrook Rd., Woodbridge, Conn.

[21] Appl. No.: 783,676

[22] Filed: Apr. 1, 1977

[51] Int. Cl.[2] ..... A47B 19/00

[52] U.S. Cl. ..... 362/98; 362/33; 362/303

[58] Field of Search ..... 240/4, 46.07, 46.31; 362/33, 97–99, 118, 303, 360

[56] References Cited

U.S. PATENT DOCUMENTS

| | | | |
|---|---|---|---|
| 1,605,843 | 11/1926 | Jones | 362/98 |
| 1,899,499 | 2/1933 | Ferree et al. | 362/98 |
| 1,969,306 | 8/1934 | Hunter | 362/98 |
| 2,345,235 | 3/1944 | Carter, Jr. | 240/46.31 X |
| 2,443,829 | 6/1948 | Lancry et al. | 240/4 |
| 2,491,448 | 12/1949 | Hillenbrand et al. | 362/303 X |
| 2,590,657 | 3/1952 | Shepard | 362/98 X |
| 2,722,862 | 11/1955 | Schwede | 240/46.31 X |
| 2,892,077 | 6/1959 | Rosenstein | 240/46.07 X |
| 2,896,066 | 7/1959 | Quetin | 362/33 |
| 3,062,954 | 11/1962 | Goolsby | 362/360 |
| 3,219,813 | 11/1965 | Peck | 240/46.07 X |
| 3,239,659 | 3/1966 | Makas | 362/19 |
| 3,597,605 | 8/1971 | Kane et al. | 362/98 |
| 3,858,040 | 12/1974 | Richard | 240/41.3 |
| 3,860,903 | 1/1975 | Van Steenhoven | 240/46.07 X |

FOREIGN PATENT DOCUMENTS

| | | | |
|---|---|---|---|
| 557001 | 11/1973 | Switzerland | 240/46.31 |

*Primary Examiner*—Peter A. Nelson

*Attorney, Agent, or Firm*—DeLio and Montgomery

[57] ABSTRACT

A lighting system wherein a task-oriented light source is supplemented by the provision of a screen or baffle so located in relation to the positions of the source, the task and the observer as to block out or modify, in whole or in part, the light reaching the task at angles such as would produce veiling reflections. The screen or baffle may be metal, plastic, glass or other solid material and may be flat, curved or louvered; it also may be fixed or adjustable.

8 Claims, 7 Drawing Figures

LIGHTING SYSTEM WITH BAFFLE

This invention relates to a lighting system, particularly of the task-oriented type, which includes a screen or baffle so located as to occlude, wholly or partially, the light from the light source which would otherwise strike the task in a position and at an angle such as to produce a veiling reflection at the point of observation.

Light from a source, such as a desk lamp or elongated luminaire, striking a "task" resting horizontally on a desk surface is reflected at an angle corresponding to the angle of incidence. Such reflection, at the eye of an observer, reduces the contrast between light and dark areas of the work (e.g., a white page and dark type printed thereon) and is termed a "veiling reflection".

Efforts to reduce or eliminate veiling reflections have included such expedients as the provision of lenses beneath the light source designed to refract laterally substantial proportions of the light, while the task still receives adequate amounts but of reduced magnitude. While such an arrangement has some merit there remain some veiling reflections in each vertical plane through the task and the eye of the observer whenever said planes also include a portion of the light source.

In applicant's U.S. Pat. No. 3,389,246, June 18, 1968, a combined desk, wall partition and lighting fixture is disclosed, the fixture including fluorescent tubes and upper and lower light control devices, shown as comprising rectangular grille baffles for directing the light vertically upward at the ceiling and downward toward the desk surface. Because of the horizontal areas of the openings in the lower grille, light may be able to reach a task on the desk surface at an angle such as to create veiling reflections into the eyes of the observer, even though all direct glare is eliminated.

It is accordingly an object of the present invention to provide a lighting system which includes an elongated light source and a screen or baffle so located as to prevent light from reaching the task along paths which would create veiling reflections. The position of the observer, whether constant or variable, must be considered as a factor in determining the dimensions of the screen or baffle and the need for adjustability.

It is another object of the invention to provide a screen or baffle assembly adapted for installation in operative relation to any standard light source.

It is a further object of the invention to provide a screen or baffle (hereinafter referred to as a "baffle") which occludes only the light which would otherwise cause veiling reflections while permitting full illumination of the task by other light, and illumination of areas other than the task by the partially occluded light.

It is a still further object of the invention to provide a lighting system wherein the elimination of veiling reflections is effected by means which do not or need not include lenses, refractors or reflecting elements.

It is yet another object of the invention to provide certain improvements in the form, construction and arrangement of the several elements by which the above-named and other objects may effectively be attained.

The invention accordingly comprises an article of manufacture possessing the features, properties, and the relation of elements which will be exemplified in the article hereinafter described, and the scope of the invention will be indicated in the claims.

A practical embodiment of the invention is shown in the accompanying drawing wherein.

Figure 2:
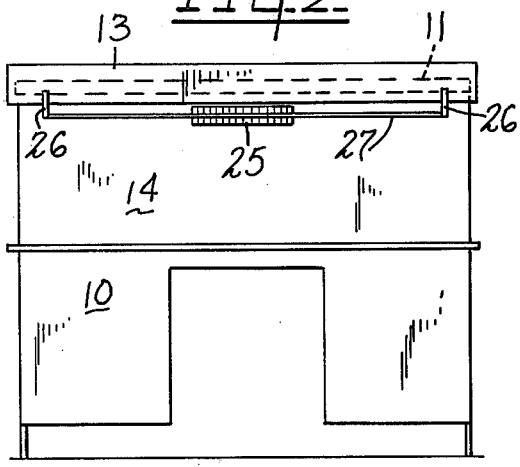
FIG. 2 represents a front view of a desk, lighting fixture and baffle shown in FIG. 1.
Figure 2A:
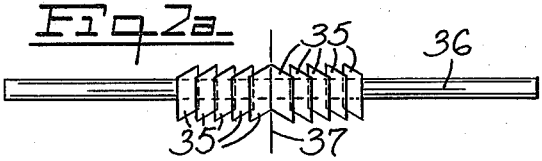
Figure 2B:
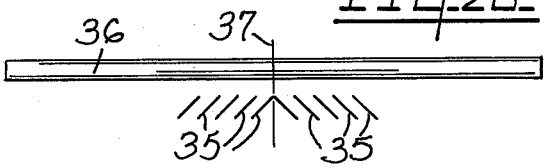

FIG. 2*a* represents a detail elevation of a fluorescent tube and a typical baffle;

FIG. 2*b* represents a detail top plan view of the tube and baffle shown in FIG. 2*a;*

Figure 3:
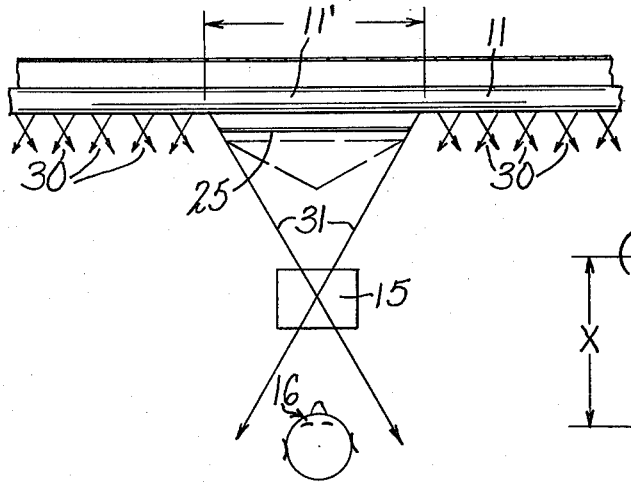
Figure 4:
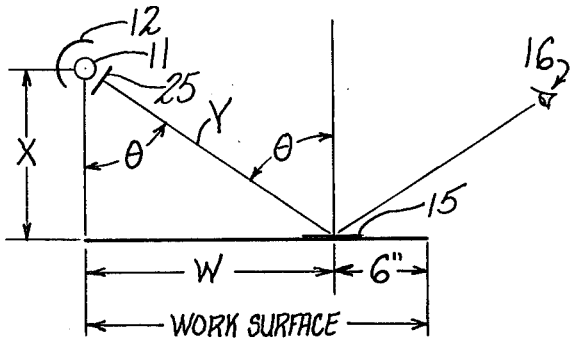
Figure 5:
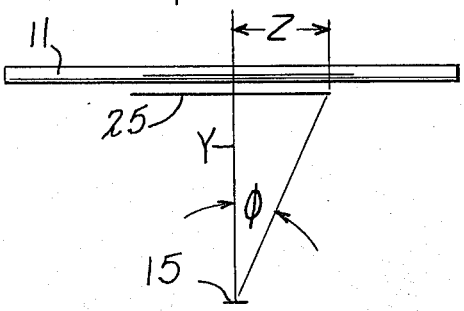

FIG. 3 is a diagrammatic view, from above, showing the relative position of a light tube, baffle, task and observer, with light paths indicated;

FIG. 4 is a diagrammatic view, in the vertical plane of the baffle, task and observer to aid in explaining certain dimensional and positional factors; and FIG. 5 is a diagrammatic view from above, supplementing FIGS. 3 and 4.

Figure 1:
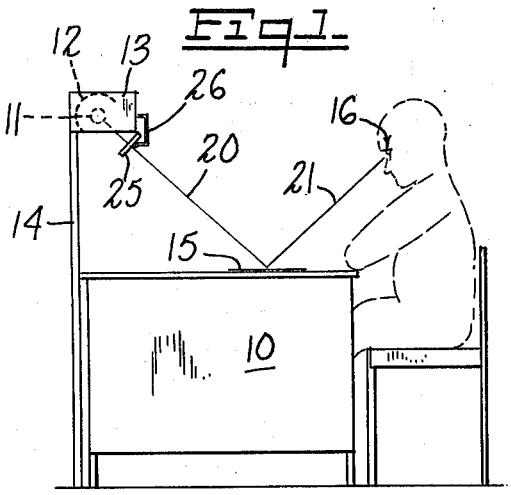
FIG. 1 represents, somewhat diagrammatically, a side elevation of a desk, lighting fixture and baffle, with the position of an observer in a normal position being indicated in broken line.

Referring to the drawing, and particularly to FIGS. 1 and 2, the elements which are basic to a task lighting system, regardless of the room lighting, if any, include a support such as the desk 10, a light source such as the tube 11, usually with a reflector 12 and housing 13 and a support 14 for the source, reflector and housing. The support may be a partition, as illustrated, or one or more posts. The task to be illuminated is located on the desk in the area designated 15 and the point of observation (i.e., the observer's eyes) is assumed to be at 16.

It is evident that light from the source following the path 20 and striking the task area 15 will be reflected at the same angle, on the path 21, toward the point of observation 16, and will create veiling reflections which may interfere seriously with observation of the task, such as reading a printed text. It is also clear that adequate illumination, without veiling reflections, is most desirable. To achieve this result the lighting fixture is provided with a baffle 25, preferably adjustably mounted to the enclosure 13 or on a support 26 which is shown as including a rod 27, the baffle being located adjacent the portion of the light source from which the light causing veiling reflections originates. Assuming that the observer is located adjacent the middle of the desk with the task directly in front of him, the baffle should be located opposite the middle of the desk in front of the light source and in a position to prevent light emitted by the part of the source directly in front of the observer from reaching the task, completely or almost so.

The resulting distribution of light is illustrated in FIG. 3 wherein light from the portion 11' of the light source 11 in front of the observer is prevented by the baffle 25 from reaching the task area 15. The latter is, however, illuminated by light from both end portions of the source, as indicated by the small crossed arrows 30, the light beams which come nearest to causing veiling reflections being indicated by the longer crossed arrows 31. So long as the observer, at 16, maintains a position between the diverging light paths 31, no veiling reflections will be observed. If the observer needs or wishes to move right or left, provision can be made for lateral adjustment of the baffle, as by movement laterally on the enclosure or on supporting rod 27 or otherwise.

The baffle may be of any suitable material or materials including metal, plastic, wood or glass, and it may be a solid narrow elongated plate which is opaque or somewhat translucent, or formed as an assembly of shutter-like elements. FIGS. 2*a* and 2*b* illustrate the latter arrangement wherein small flat plates 35 are mounted so as to lie in parallel planes forming acute angles with the axis of the light source 36 angled oppositely each side of the center line 37. When viewed from a position in or near the vertical plane of the center line the edges of the plates should overlap, or nearly so, in order that little or no light from the center portion of the source can go directly to the task area (assumed to be on the center line) while such light passes freely along diverging paths to areas to the right and left of the task. In this manner the loss of light energy in the fixture is minimized.

The principle of the above bi-directional one-way louver would be similar to the principle of a batwing lens. Light is allowed to emanate say 30 to 60 degrees to the left and to the right of straight out, but is prevented form emanating straight out.

The baffle could be mounted on rods, or in door frame slots, or in any way that would place it within 12" or less from the light source and/or clear enclosure. Step-by-step adjustment would be acceptable in lieu of sliding. The position could even by fixed, if an assumption can be made as to the area of the task surface to be most likely used for a great majority of the user's work time, or if the user's position was fixed.

The baffle must be large enough to occlude light from the lamp and/or reflector and/or lens and/or diffuser. The baffle is thus approximately four inches to forty-six inches (left-right) measured along the axis of the light source. The baffle is located immediately in front of the lamp and/or reflector and/or lens and/or diffuser and/or clear enclosure (between the light source and the visual task).

FIGS. 4 and 5 illustrate the geometry for determining the length of the baffle. The task area 15 is normally assumed to be centered about six inches from the front edge of the work surface. The height of the light source is from 10" above the work surface to standing eye height above the floor, e.g. from 10" to 36" above the work surface. The work surface (W+6") would usually be from 12" to 48". Referring to FIGS. 4 and 5:

$\theta = \text{arc tan } W/X$ $Y = X/\cos\theta$ $\phi = \frac{1}{2}$ of occluding angle ($\frac{1}{2}$ of 20° to 45°)

$Z = Y \tan \phi$

Length of baffle (25)$=2Z$

While a louver-type baffle is shown in FIGS. 2*a* and 2*b*, it will be understood that an opaque or translucent screen could be used, or a clear batwing lens arranged to refract the light laterally. The material can be metal, glass, plastic, cardboard or a linear polarizing material, producing vertically polarized light, the requirement in every case except the linear polarizer being that the screen or baffle (referred to generally as "baffle") must wholly or partially occlude light emanating from the source in a direction that would cause veiling reflections at the task. Vertically polarized light inherently reduces veiling reflections.

Reference herein to an "elongated light source" includes not only such devices as fluorescent tubes but also assemblies wherein light from a shorter bulb is caused to take an effectively elongated form by means of reflecting surfaces and/or refracting lenses. Light from the source must be able to illuminate the task, but at an angle or angles such that veiling reflections are not caused.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. A task-oriented lighting system for illuminating a task supported in a substantially horizontal position and adapted to be viewed primarily from a first direction and from an observation point located laterally at elevations between sitting eye height and standing eye height, comprising a horizontally elongated linear light source having its long axis substantially perpendicular to said first direction, and light occluding means interposed between the light source and the task and extending laterally far enough to intersect every vertical plane passing through the light source, the observation point and the task, whereby light from the source which could cause veiling reflections from the task is at least partially occluded and the light source extending laterally far enough beyond the occluding means to illuminate directly the task by light traversing vertical planes which do not pass through the observation point.

2. A task-oriented lighting system according to claim 1 wherein the occluding means is an opaque screen.

3. A task-oriented lighting system according to claim 1 wherein the occluding means is a baffle so constructed as to intercept light traveling in each of said first named vertical planes and to permit passage of light in other directions.

4. A task-oriented lighting system according to claim 3 wherein the baffle is constituted by substantially parallel shutter-like elements.

5. A task-oriented lighting system according to claim 4 wherein the shutter-like elements are in two groups, oppositely angled to form a bi-directional baffle.

6. A task-oriented lighting system according to claim 1 wherein the occluding means is of constant width and is laterally adjustable.

7. A task-oriented lighting system according to claim 1 wherein the light source is an element of a luminaire, which includes means for supporting the light occluding means.

8. A task-oriented lighting system according to claim 7 wherein the occluding means is of constant width and is laterally adjustable.

* * * * *